United States Patent [19]

Lenk

[11] Patent Number: 4,801,257

[45] Date of Patent: Jan. 31, 1989

[54] MELT SPINNING APPARATUS

[75] Inventor: Erich Lenk, Remscheid, Fed. Rep. of Germany

[73] Assignee: Barmag AG, Remscheid, Fed. Rep. of Germany

[21] Appl. No.: 133,431

[22] Filed: Dec. 15, 1987

[30] Foreign Application Priority Data

Dec. 16, 1986 [DE] Fed. Rep. of Germany ..... 3642867

[51] Int. Cl.[4] ..... B29C 47/12

[52] U.S. Cl. ..... 425/192 S; 264/176.1; 403/323; 403/324; 425/464; 425/378.2

[58] Field of Search ..... 264/176.1; 403/323, 403/324, 378, 379; 425/72.2, 185, 186, 188, 190, 192 R, 192 S, 193, 195, 378 S, 379 S, 382.2, 461, 464; 100/918

[56] References Cited

U.S. PATENT DOCUMENTS

| | | | |
|---|---|---|---|
| 3,407,437 | 10/1968 | Lenk | 425/464 |
| 3,655,314 | 4/1972 | Lenk et al. | 425/192 S |
| 3,891,379 | 6/1975 | Lenk | 425/464 |
| 4,038,005 | 7/1977 | Lenk | 425/190 |
| 4,358,261 | 11/1982 | Ohki | 425/186 |
| 4,402,519 | 9/1983 | Meaden et al. | 403/324 |
| 4,493,628 | 1/1985 | Lenk | 425/192 S |
| 4,645,444 | 2/1987 | Lenk et al. | 425/192 S |
| 4,652,410 | 3/1987 | Inoue et al. | 425/186 |
| 4,681,522 | 7/1987 | Lenk | 425/382.2 |
| 4,696,633 | 9/1987 | Lenk et al. | 425/192 S |
| 4,698,008 | 10/1987 | Lenk et al. | 425/192 S |
| 4,704,077 | 11/1987 | Lenk | 425/131.5 |

FOREIGN PATENT DOCUMENTS

| | | | |
|---|---|---|---|
| 3024108 | 8/1987 | Fed. Rep. of Germany . | |
| 43-14176 | 6/1968 | Japan | 425/192 S |
| 1350496 | 4/1974 | United Kingdom . | |

*Primary Examiner*—Jay H. Woo
*Assistant Examiner*—C. Scott Bushey
*Attorney, Agent, or Firm*—Bell, Seltzer, Park & Gibson

[57] ABSTRACT

A melt spinning apparatus is disclosed wherein the spinning head is inserted in an upward manner from beneath into the lower end of a vertically extending opening in a heater box. Upwardly directed air currents are avoided in the vertically extending opening by providing a metallic contact, in the form of supporting and locking strips, between the heating box and the spinning head. The supporting and locking strips provide for the easy removal and insertion of the spinning head into and out of the heating box from beneath. The upper end of the spinning head is closed, and the internal walls of the vertically extending opening in the heater box and the external walls of adjacent spinning head are provided with internal contact surfaces which collectively define horizontal channels. The supporting and locking strips are positioned in the channels, and they include corresponding supporting surfaces engaging the contact surfaces of the spinning head and the heating box, for supporting the spinning head in the heating box, and for permitting easy removal of the spinning head from the heating box in a downward direction.

12 Claims, 3 Drawing Sheets

MELT SPINNING APPARATUS

FIELD OF THE INVENTION

This invention relates generally to an apparatus for melt spinning synthetic filament yarns of the type which includes a heating box with a rectangular spinning head supported therein and supporting one or more spinneret nozzles, and more particularly to such an apparatus in which the spinning head may be easily and quickly removed from the heating box in a downward direction.

BACKGROUND OF THE INVENTION

U.S. Pat. No. 4,645,444 and British Pat. No. 1,350,496 generally disclose spinning systems of the known type in which at least one wall of the heating box is movable so that the spinning head can be clamped in position between the fixed walls and the movable wall of the vertical opening in the heating box in which the spinning head is supported. This type of spinning system produces a good transfer of heat between the heating box and the spinning head. However, this system of clamping the spinning head in position in the heating box has the disadvantage that the spinning head is normally removed only in an upward direction and the components of the heating box must be disassembled from each other in order to remove the spinning head. The spinning system disclosed in British Pat. No. 1,350,496 also has the disadvantage that the outer portions of the opening in the heating box remain open in an upward direction so that a strong heat convection or "chimney" effect is present and a substantial loss of heat occurs so that irregular temperatures in the spinning head can result.

SUMMARY OF THE INVENTION

It is accordingly an object of the present invention to provide a melt spinning apparatus constructed in such a manner that the spinning head can be inserted and removed from beneath the heating box so that heat loss through convection is avoided and so that metallic heat contact is maintained between the internal walls in the opening of the heating box and the side walls of the spinning head to provide good transfer of heat from the heating box to the spinning head and so that practically no temperature differences exist between the two.

In accordance with the present invention, the heating box has a vertically extending opening of rectilinear cross section and including internal walls, and the spinning head is inserted in the opening and includes external walls which correspond in cross section with the internal walls of the opening of the heating box, and are disposed closely adjacent thereto. Also, a pair of opposing vertical walls are thereby defined which are positioned adjacent each other on two opposite sides of the spinning head. Means are provided for supporting the spinning head in the heater box, and which comprises an internal contact surface extending along the internal wall and the external wall of each pair of opposed walls, with the internal contact surfaces being aligned to collectively define a channel therebetween. Also, a supporting and locking strip means is positioned in each channel for maintaining the spinning head in position in the vertical opening and for permitting easy removal therefrom in the downward direction.

The internal contact surfaces include portions which are inclined toward the direction of assembly, in other words, toward the vertical and also toward the horizontal. Also, these internal contact surfaces are aligned parallel to each other in the horizontal direction when the spinning head is inserted into the opening in the heating box. The internal contact surfaces must include inclined portions to that they can transfer the weight and pressures of the spinning head to the heating box by means of the supporting and locking strip. The supporting and locking strips have opposed surfaces which are adapted to contact the inclined contact surfaces on the spinning head and the heating box to lock the spinning head in position in the opening in the spinning box. The supporting and locking strips provide a metallic contact between the heating box and the spinning head to insure transfer of heat from the heating box to the spinning head. In the assembled condition, the load bearing surfaces of the internal contact surfaces cooperate and are aligned to form horizontal channels in which the supporting strips are placed. The supporting strips are shaped in such a manner that they mate with and correspond to the cross-section of the horizontal channels when the spinning head is inserted into the opening in the heating box in assembled condition.

In one embodiment of the invention, the supporting and locking strips are adapted to be pushed in a longitudinal direction into the horizontal channels formed by the internal contact surfaces for the purpose of inserting and supporting the spinning head into the heating box, and they are adapted to be pulled out from the channels for the purpose of removing the spinning head from the heating box. In this embodiment, the supporting and locking strips have substantially the same cross-sectional configuration as the horizontal channels.

The longitudinal sliding movement of the supporting and locking strips may present a constructional obstacle. In such cases, this type of constructional obstacle is avoided in another embodiment of the invention by forming the internal contact surfaces as grooves in the form of segments of a circular opening. The supporting and locking strips are also constructed as a segment of the same circular cylinder, with the circular segment of the supporting and locking strip corresponding approximately to the circular groove segment formed in the heating box. With this arrangement, the supporting and locking strip is merely rotated so that the cutaway portion is aligned with the internal wall of the opening of the heating box for removal or insertion of the spinning head. When the supporting strip is rotated so that the cutaway segment extends between the spinning head and the heating box at an angle, the opposed circular contact surfaces of the supporting strip are in contacting engagement with the circular contact surfaces in the spinning head and the heating box to lock the spinning head in engagement and provide good heat transfer between the heating box and the spinning head.

In this embodiment wherein circular supporting strips are used to lock the spinning head in the heating box, the center line or axis of rotation of the circular supporting strip is not positioned along the separating plane between the spinning head and the heating box, but is displaced in the direction of the heating box. Preferably, the center of rotation is located in the internal wall of the heating box a distance which corresponds to approximately ten to fifteen percent of the diameter of the circular supporting strip. Since the cross-section of the supporting strip corresponds substantially to the cross-section of the circular groove in the internal wall of the heating box, the supporting strip encompasses a cylindrical jacket with a sector angle greater than 180° while the cutaway portion encompasses less than 180°. This enlarged contact surface is thus provided for producing a good metallic contact between the spinning head and the heating box.

In the embodiment utilizing a rotating supporting strip for maintaining the spinning head in the heating box, there is a possibility that rotation of the supporting strip will accidentally occur and may permit the spinning head to be released from the heating box. For this reason, a safety catch is provided with prevents the spinning head from falling unintentionally out of its opening in the heating box. It is preferred to construct the safety catch in such a manner that it can be automatically released by a supporting means, which is, for example, mounted with a mechanical lifting device under the spinning head.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
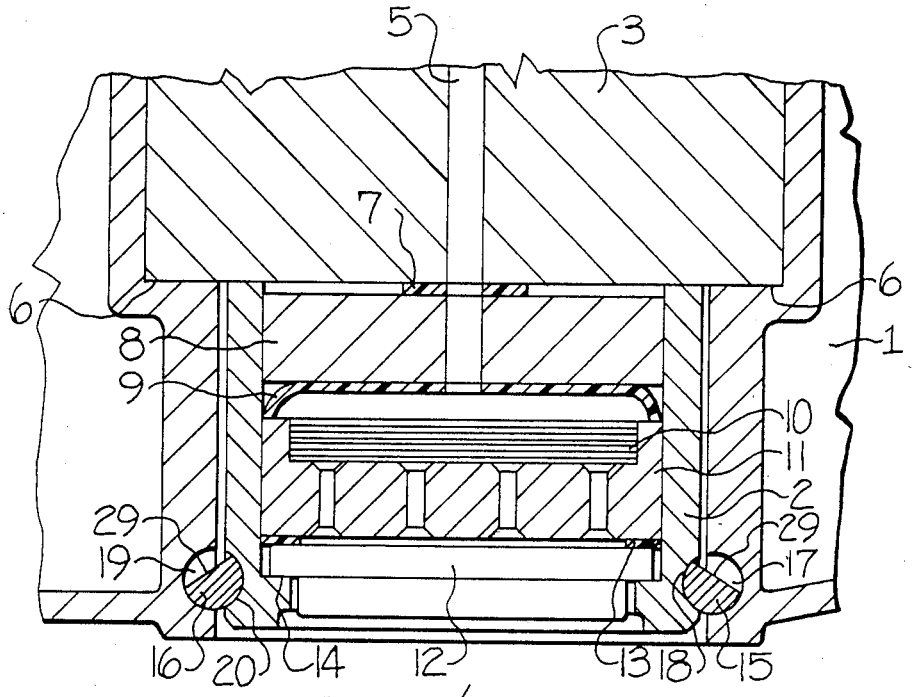
FIG. 1 is a fragmentary vertical sectional view through the spinning system and illustrating one embodiment of the means for supporting the spinning head in a locked condition in the heating box.

Only a fragmentary cross-sectional portion of a heating box 1 is shown in each of the drawings and includes closed chambers which are filled with a heated fluid or a vapor which condenses on the walls and heats the heating box 1 in a uniform manner. The heating box 1 is provided with a vertically extending opening including internal walls into which a rectangular spinning head 2 is inserted from below, in a manner to be presently described. A pump block or any other suitable type of heat carrier block 3 (FIG. 1) is supported above the spinning head 2 and rests on supporting surfaces 6 of the heating box 1 to tightly close the top of the vertically extending opening in which the spinning head 2 is positioned. A melt passageway or conduit 5 extends through the pump block 3, and then through a seal 7, and a piston 8 which slides in the spinning head 2. A membrane 9 seals the lower portion of the spinning head 2. The lower portion of the spinning head 2 accommodates a filter 10, which rests on a distributor member 11. A seal 13 seals the distributor 11 against a spinneret 12, the lower surface of which is supported on supporting surfaces 14 of the spinning head 2. A seal of this type is illustrated in U.S. Pat. No. 4,645,444. However, it is to be understood that other types of seals may also be used, such as, for example, self-sealing tubes which are inserted into the melt conduit and seal the seam between the pump block 3 and the spinning head 2.

The spinning head 2 is illustrated as being rectangular and is longer in the transverse plane (the plane extending toward and away from the observer) than the width in the longitudinal plane which extends parallel to the drawing in FIG. 1 and perpendicular to the transverse plane. One or more spinnerets 12 may be mounted in the spinning head 2. The cross sectional outline of the internal walls of the vertically extending opening formed in the heating box and providing a heating chamber correspond substantially to the cross sectional outline of the external walls of the rectangular spinning head 2. While the transverse and longitudinal walls of the spinning head 2 are positioned closely adjacent the internal walls of the vertically extending opening in the heating box, there exists a slight gap therebetween, as illustrated in FIG. 1, so that the spinning head 2 can be easily inserted into and removed from the vertically extending opening in the heating box 1.

The longitudinal external walls of the spinning head 2 (extending perpendicular to the drawing plane) and the adjacent internal walls of the heating box 1 define a pair of opposing and closely adjacent vertical walls on each of the two opposite sides of the spinning head 1. Also, the external and internal walls of each such pair are provided with internal contact surfaces, illustrated as longitudinal grooves 17, 18 on the right-hand side of FIG. 1 and longitudinal grooves 19, 20 on the left-hand side of FIG. 1 and at approximately the height of the spinneret 12. In the installed position of the spinning head 2, these longitudinal grooves 17, 18 and 19, 20 are aligned opposite each other, and extend horizontally. When aligned in this manner, a horizontal channel is formed which is circular in cross-section in FIG. 1 and into which is inserted a circular supporting and locking strip 15 on the right-hand side of FIG. 1 and a circular supporting and locking strip 16 on the left-hand side of FIG. 1.

Figure 3A:
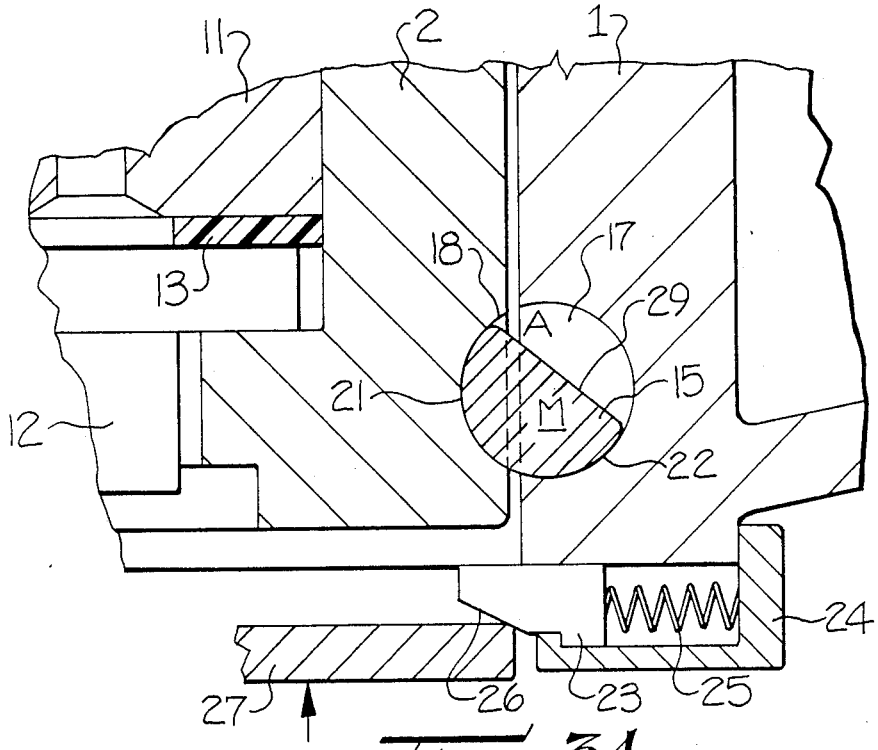
FIGS. 3A and 3B illustrate further embodiments of the supporting strips utilized in maintaining the spinning head in position in the heating box.
Figure 3B:
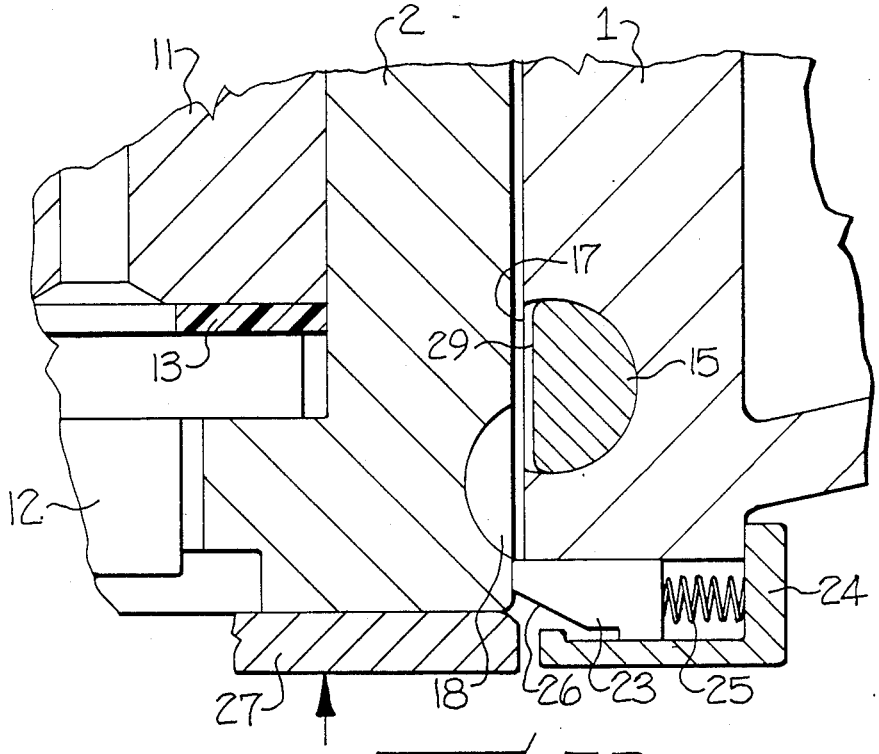

FIGS. 3A and 3B illustrate the circular supporting and locking strip 15 inserted between the heating box 1 and the spinning head 2, and shown in the respective locked and unlocked positions. With the spinning head 2 in the installed position, as shown in FIG. 3A, the two aligned longitudinal grooves 17, 18 form a circular cross-sectional channel which circumscribes and surrounds the outer surface of the circular supporting and locking strip or cylinder 15. The rotational center M of the circular supporting and locking strip 15 (FIG. 3A) is not located in the space or gap between the walls of the heating box 1 and the spinning head 2 but is laterally displaced or offset into the area of the longitudinal groove 17 in the heating box 1. The distance, indicated at A, from the internal wall of the heating box 1 preferably measures about ten to fifteen percent of the total diameter of the supporting and locking cylinder 15. The supporting and locking cylinder 15 has substantially the same diameter as the circular opening formed by the longitudinal grooves 17, 18, but is cut away in part in the longitudinal direction so that its cross-section corresponds substantially to the cross-section of the longitudinal grooves 17 in the internal wall of the heating box 1, as indicated in FIG. 3B. Thus, the cutaway segment of the supporting and locking cylinder encompasses less than 180° while the locking segment encompasses more than 180°.

When the spinning head 2 is to be installed or removed, the supporting cylindrical strip 15 is rotated from the position shown in FIG. 3A to the position shown in FIG. 3B so that its cut-away portion is substantially flush with the internal wall of the heating box 1. In this position, the spinning head 2 can be vertically moved into installed position or removed from the heating box 1 by raising or lowering an elevating platform 27. When the spinning head 2 has reached its installed position, as shown in FIG. 3A, the cylindrical supporting strip 15 is rotated so that it contacts the largest possible surface area of the longitudinal groove 18. The lifting device or elevating platform 27 can then be lowered and the spinning head 2 is supported and held by its contact surface in the area of the longitudinal groove 18 and over the circumference of the supporting strip cylinder 15 and on the contact surface of the longitudinal groove 17 of the heating box 1. A safety catch or locking bar 23 extends in a straight guideway 24 parallel to the underside of the spinning head 2 and is pushed by a spring 25 into the open area of the open shaft. The safety catch 23 is provided with a sliding cam surface 26 inclined relative to the horizontal. When the lifting device 27 is raised into the area of the open shaft, as shown in FIG. 3B, the safety catch 23 is laterally pushed out of the shaft area so that the spinning head 2 can be removed in a downward direction. When the lifting platform 27 is again lowered, the safety catch 23 returns to the shaft area, as shown in FIG. 3A. The safety catch 23 thus prevents the spinning head 2 from accidentally falling out of the vertically extending opening in the heating box 1, should the cylindrical supporting strip 15 be inadvertently rotated, so that the spinning head 2 will still be supported from the bottom by the safety catch 23.

Figure 5:
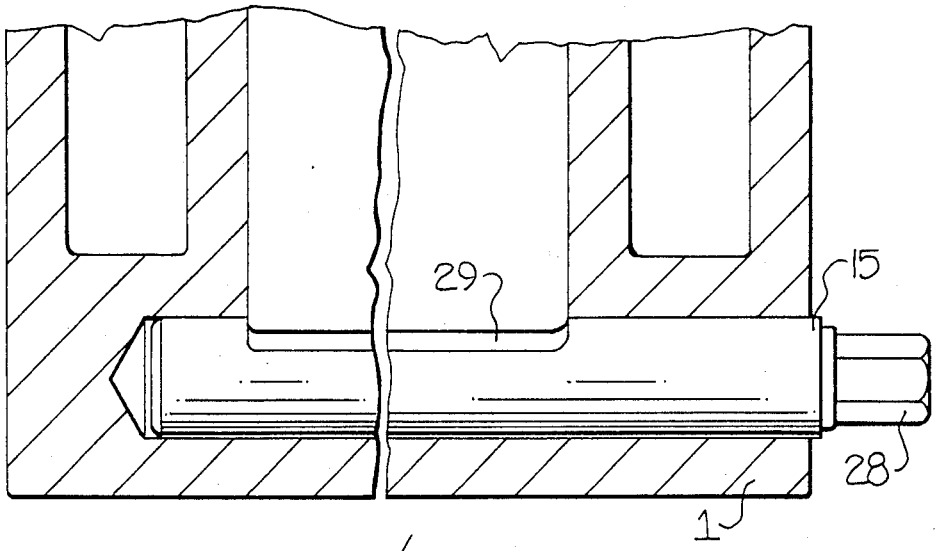
FIG. 5 is a horizontal sectional view illustrating the manner in which the supporting strip is supported for rotation in the heating box.

A horizontal sectional view of the spinning system is shown in FIG. 5 extending substantially along the longitudinal axis of the supporting and locking cylindrical strip 15. The supporting and locking cylindrical strip 15 is illustrated as a round pin or rod and the shaft is rotatably supported in the cylindrical opening formed by the longitudinal grooves 17, 18. A hexagonal head 28 is provided on the outer end of the supporting and locking cylindrical strip 15 and is provided for rotation of the supporting and locking cylindrical strip 15 by means of a wrench. In the area of the vertically extending opening in the heating box 1, the cutaway portion of the cylindrical supporting and locking pin 15 forms a flattened portion 29.

Figure 4:
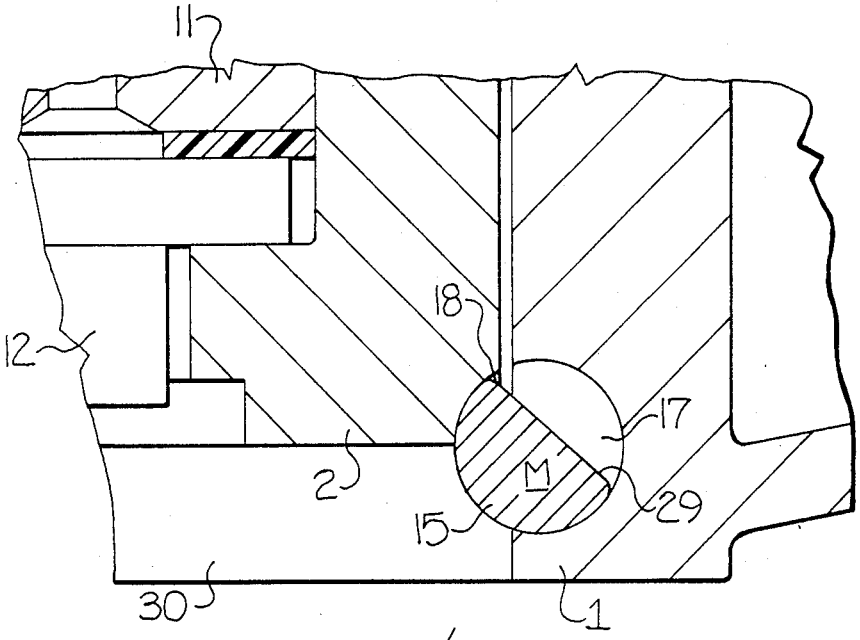
FIG. 4 is a view similar to FIGS. 3A and 3B but illustrating a further embodiment of the supporting strip.

FIG. 4 illustrates an alternative embodiment of the mounting of the spinning head 2 in the heating box 1. This embodiment differs from the embodiments of FIGS. 3A and 3B in that the longitudinal groove 18 forms a small segment of a circle and is formed along the lower longitudinal edge of the spinning head 2. In this embodiment, only the portion of the contact surface of the longitudinal groove 18 which is located above the horizontal plane extending to the rotational center M supports the spinning head 2. This type of construction permits the heating box to project downwardly somewhat further beyond the lower edge of the spinning head 2 so that a hot air cushion forms in the space of the vertically extending opening, as indicated at 30, which is positioned below the spinneret 12.

Figure 2:
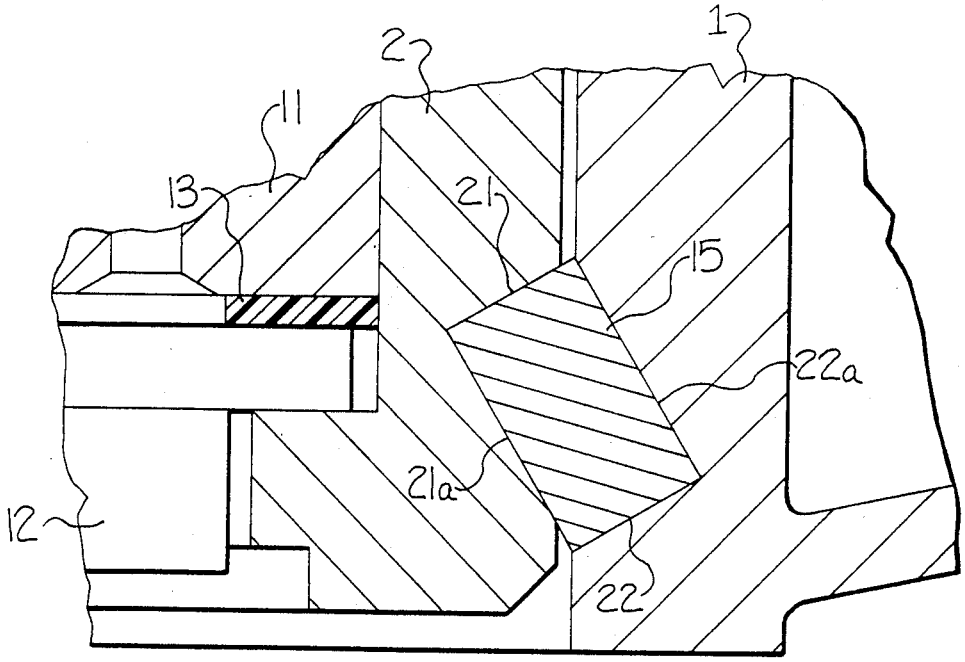
FIG. 2 is an enlarged framentary vertical sectional view illustrating the lower portions of a spinning head and a heating box and illustrating a second embodiment of a supporting strip for maintaining the spinning head in position in the heating box.

Another alternative embodiment representative of the principle of the present invention is illustrated in FIG. 2. In this embodiment, the adjacent longitudinal internal contact surfaces have a rectangular cross-section which is oriented in an oblique direction with respect to the associated vertical internal and external walls, and so that each of the internal contact surfaces comprises two flat surfaces 21, 21*a* and 22, 22*a* at right angles to each other. The two longitudinal grooves together form a quadrangle of preferably either a rectangle or a square. The supporting and locking strip 15 (as well as the locking strip 16, not shown) have a corresponding cross-section which is illustrated as being rectangular. The upper and lower surfaces of the rectangular supporting and locking strip 15 are supported on the inclined contact surfaces 21 and 22 of the spinning head 2 and the heating box 1, respectively. The contact surfaces 21, 22 are inclined both relative to the horizontal and the vertical so that the weight and the pressure of the spinning head 2 is transmitted by means of the supporting strip 15 to the heating box 1. By reason of this inclination, the surfaces 21, 22 form an angle between each surface and the associated internal or external wall which is more than 90°. In this embodiment it is necessary for the installation and removal of the spinning head 2 to pull out the supporting strip 15 in the longitudinal direction from the aligned longitudinal grooves and to insert the supporting strip 15 into the longitudinal grooves to install and lock the spinning head 2 in position.

The present invention provides special advantages in that it permits installing and removing the spinning head in a very simple manner and with the vertically extending opening in the heating box being closed at the upper end so that the spinning head can be installed and removed from below. This simple operation also provides a good heat conducting metallic contact between the heating box and the spinning head so that uniform temperatures are maintained throughout the spinning head. This metallic contact extends over a fairly large surface area since the supporting strips extend along the longitudinal sides and over the entire length of the rectangular spinning head. Another advantage resides in the fact that the metallic supporting strips close the gap between the shaft walls of the heating box and the walls of the spinning head in the lower portion so that no substantial amount of air exchange can occur.

If desired, corresponding supporting and locking strips can be arranged on somewhat higher or lower planes in the transverse walls of the heating box and the adjacent spinning head. However, it has not been found to be necessary that the additional supporting and locking strips be provided since a uniform temperature is maintained by the metallic contact in the area of the longitudinal walls.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which is claimed is:

1. In a spinning apparatus for melt spinning synthetic filament yarns including a heating box having a vertically extending opening formed therein of rectilinear cross section and including internal walls, a spinning head inserted in said vertically extending opening and including external walls corresponding in cross section with said internal walls of said opening of said heating box and being disposed closely adjacent thereto, and so that a pair of opposing vertical walls are positioned adjacent each other on two opposite sides of said spinning head, said vertically extending opening being closed in the upper end portion above said spinning head, and including means for supporting said spinning head in said heater box, said supporting means including an internal contact surface extending along each internal and external wall of each of said pairs of opposing walls, with the internal contact surfaces being aligned to collectively define a channel therebetween, and a supporting and locking strip means positioned in each of said channels for maintaining said spinning head in position in said vertically extending opening and permitting easy removal therefrom in a downward direction.

2. In a spinning apparatus according to claim 1 wherein said internal contact surfaces define horizontal channels which are of circular cross section.

3. In a spinning apparatus according to claim 2 wherein the rotational center line of each of said circular channels is offset relative to a separating plane between said heating box and said spinning head, and wherein said rotational center line is offset from the separating plane by a distance of approximately ten to fifteen percent of the diameter of said circular channel.

4. In a spinning apparatus according to claim 3 wherein said rotational center of each of said circular channels is offset into the internal wall of said heating box.

5. In a spinning apparatus according to claim 4 wherein the cross section of each of said supporting and locking strip means is a segment of a circle having about the same diameter as the associated circular channel.

6. In a spinning apparatus according to claim 5 wherein the cross section of each of said circular supporting and locking strip means includes a cutaway segment of less than 180°.

7. In a spinning apparatus according to claim 6 wherein each of said supporting and locking strip means is supported for rotation in the associated circular channel.

8. In a spinning apparatus according to claim 1 further comprising a safety catch extending in its operative position into a lower end of said vertically extending opening and forming a stop to prevent accidental removal of said spinning head in a downward direction.

9. In a spinning apparatus according to claim 1 wherein said internal contact surfaces define horizontal channels, and wherein each of said horizontal channels is of rectangular cross section, and wherein each of said supporting and locking strip means is of a corresponding rectangular cross section and is mounted so as to be longitudinally removable from its associated channel.

10. In a spinning apparatus according to claim 9 wherein each of said rectangular channels is oriented in an oblique direction with respect to the associated internal and external walls, and so that each of said internal contact surfaces comprises two flat surfaces at right angles to each other.

11. In a spinning apparatus according to claim 1 wherein each of said supporting and locking strips has opposite surface portions which closely match the internal contact surfaces forming the associated channel.

12. In a spinning apparatus according to claim 1 wherein each of said internal contact surfaces has a portion oriented in an oblique direction with respect to the associated internal or external wall, with the angle between said portion and the associated internal or external wall being greater than 90°.

* * * * *